United States Patent [19]

Kuroda

[11] 4,297,927

[45] Nov. 3, 1981

[54] SHEET METAL POSITIONING AND GRIPPING APPARATUS AND METHOD

[75] Inventor: Naoki Kuroda, Kyoto, Japan

[73] Assignee: The Warner & Swasey Company, Cleveland, Ohio

[21] Appl. No.: 127,800

[22] Filed: Mar. 6, 1980

[30] Foreign Application Priority Data

Mar. 24, 1979 [JP] Japan ..... 54-34721

[51] Int. Cl.[3] ..... B26D 7/01

[52] U.S. Cl. ..... 83/36; 83/13; 83/277; 83/279; 83/412; 414/753

[58] Field of Search ..... 83/277 X, 279–281, 83/412, 415, 13, 36, 50; 271/236, 242, 247, 250, 252; 414/751, 753 X

[56] References Cited

U.S. PATENT DOCUMENTS

| | | | |
|---|---|---|---|
| 3,256,761 | 6/1966 | Huntley | 83/412 |
| 3,411,389 | 11/1968 | Wiese | 83/281 X |
| 4,127,198 | 11/1978 | Morini | 83/280 X |
| 4,162,641 | 7/1979 | Stubbings | 83/412 X |
| 4,213,733 | 7/1980 | DeGeorge et al. | 83/412 X |

*Primary Examiner*—Frank T. Yost

*Attorney, Agent, or Firm*—Yount & Tarolli

[57] ABSTRACT

A sheet metal workpiece is held by holders as the workpiece is cut and moved relative to a device such as a shearing machine or punch press. An improved apparatus and method is provided to precisely position the sheet metal workpiece relative to the holders. This apparatus includes a first gripper assembly which is disposed at an opening in a support structure for the sheet metal workpiece. The first gripper assembly moves the workpiece to position it along a first axis. A second gripper assembly is disposed at another opening in the support structure and moves the workpiece to position it along a second axis which extends transversely to the first axis. The two gripper assemblies can be moved between extended positions projecting upwardly from the support structure and retracted positions in which the gripper assemblies are disposed within the support structure.

29 Claims, 8 Drawing Figures

SHEET METAL POSITIONING AND GRIPPING APPARATUS AND METHOD

BACKGROUND OF THE INVENTION

Shearing machines and punch presses have been provided with automatic loaders which position pieces of sheet metal relative to holders. The holders grip the sheet metal while it is being moved into position and cut. Although these known machines have been more or less satisfactory in their operation, the positioning of the sheet metal workpieces relative to the holders by certain known automatic loaders is not as precise as is desired.

SUMMARY OF THE PRESENT INVENTION

The present invention provides a method and apparatus for precisely positioning a sheet material workpiece relative to holders which are used to grip and move the workpiece. The apparatus includes a table upon which the workpiece is supported. The holders are disposed on a carriage which is movably mounted on a cross slide. The carriage and cross slide are moved relative to a shearing machine or punch press to move the holders and position the workpiece for cutting operations.

In accordance with the present invention, the workpiece is accurately positioned relative to the holders by a plurality of gripper assemblies. When a workpiece is placed on the support table, a transverse gripper assembly is moved from a retracted position disposed beneath an upper surface of the support table to an extended position in which it can engage an edge portion of the sheet material workpiece. The transverse gripper assembly then pulls the workpiece along a path extending parallel to a first or X axis. When the workpiece has moved to a predetermined position relative to the X axis, a leading edge of the workpiece engages a stop. A second or longitudinal gripper assembly is movable from a retracted position beneath the upper surface of the support table to an extended position in which it engages a second edge portion of the workpiece. The longitudinal gripper assembly then moves the workpiece relative to the holders to a predetermined position along a second or Y axis.

The longitudinal and transverse gripper assemblies each include a drive motor which moves the gripper assembly from a retracted position to an extended position. Once the gripper assembly has been moved to an extended position, a gripper actuator motor operates a gripper mechanism from an open condition to a closed condition to firmly grip a sheet material workpiece. The drive motor then moves the gripper assembly along a path extending parallel to the upper surface of the support table until a leading edge of the sheet material workpiece is at a predetermined position relative to the holders. After the workpiece has been aligned with the holders, the gripper assembly is operated to an open condition. Then the drive motor is again operated to move the gripper assembly back to the retracted position beneath the upper surface of the support table.

Although the gripper assemblies could be operated simultaneously or in different sequences, the transverse gripper assembly is used to move the workpiece along the X axis. Thereafter, the longitudinal gripper assembly is used to move the workpiece along the Y axis.

As the workpiece is moved into a predetermined position along the X axis by the transverse gripper assembly, a leading edge of the workpiece engages a retractable stop and actuates a detector which causes the longitudinal gripper assembly to engage the second end portion of the sheet material workpiece. The longitudinal gripper assembly then moves the workpiece along the Y axis to complete the positioning of the workpiece relative to the holders. During movement of the workpiece along the Y axis by the longitudinal gripper assembly, the workpiece is gripped by the transverse gripper assembly which moves with the workpiece to hold it in position along the X axis.

Once the workpiece has been moved to a predetermined position relative to the X and Y axes, the holders engage the workpiece. The gripper assemblies are then opened and moved to retracted positions beneath the upper surface of the support table. At the same time, the stop and detector which were engaged by the leading edge of the workpiece during its movement along the X axis are also retracted to a position beneath the upper surface of the support table.

Accordingly, it is an object of this invention to provide a new and improved method and apparatus for accurately positioning a workpiece relative to a holder which is subsequently effective to move the workpiece during a cutting operation.

Another object of this invention is to provide a new and improved method and apparatus for positioning a sheet material workpiece relative to holders and wherein a first gripper is extended through an opening in a support structure and is effective to move the workpiece to a predetermined position along a first axis and a second gripper at another opening in the support structure is effective to move the workpiece to a predetermined position along a second axis.

Another object of this invention is to provide a new and improved method and apparatus for positioning a sheet material workpiece relative to a holder and wherein a first gripper moves the workpiece in a first direction relative to a support structure and a second gripper moves the workpiece in a second direction relative to the support structure, the second gripper being effective to move both the workpiece and the first gripper relative to the support structure as the second gripper positions the workpiece.

Another object of this invention is to provide a new and improved method and apparatus as set forth in the preceding objects and wherein a retractable stop assembly detects when the workpiece is in a predetermined position relative to a holder.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
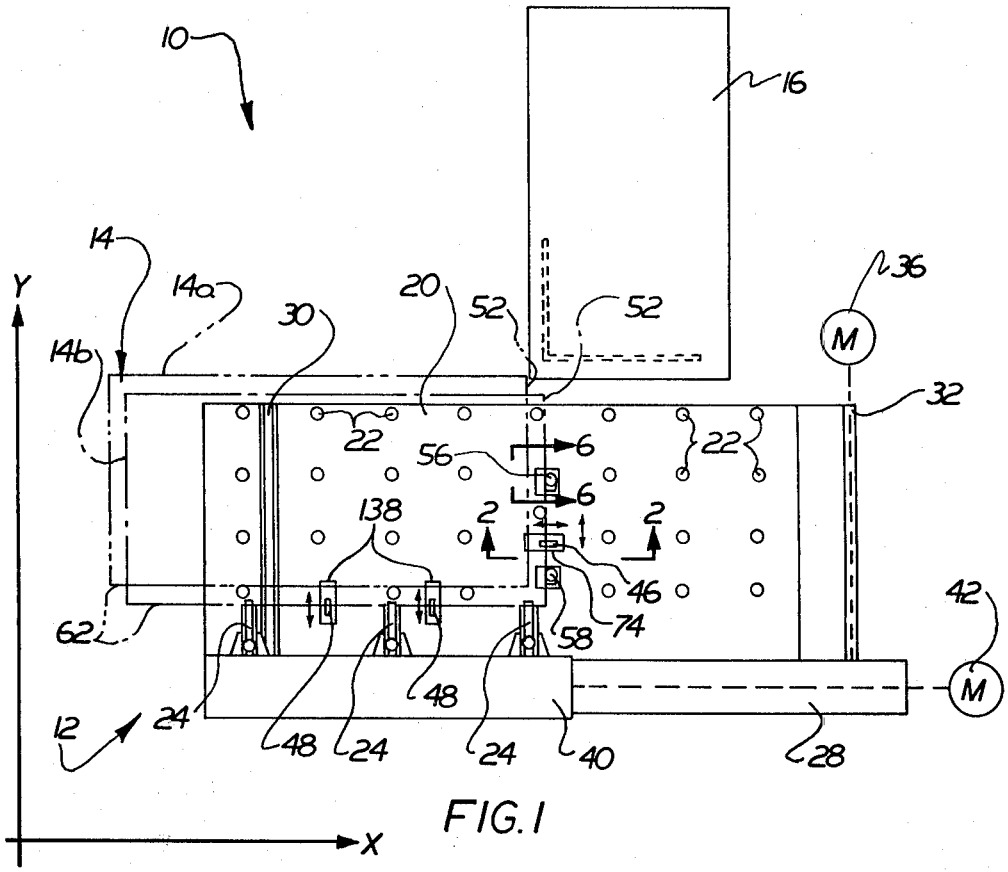
FIG. 1 is a schematic plan view of an apparatus which is constructed and operated in accordance with the present invention to accurately locate a sheet material workpiece.

A sheet handling and cutting apparatus 10 is illustrated in FIG. 1 and includes a sheet positioning assembly 12 which positions a flat sheet metal workpiece 14 relative to a cutting assembly 16. The cutting assembly 16 can be of many different constructions and can be either a shearing machine or a turret punch press of the type illustrated in U.S. Pat. Nos. 3,436,998 and 3,395,596. Although the apparatus 10 is used to cut sheet metal workpieces, it is contemplated that sheets of other materials could be used in association with an apparatus which is generally similar to the apparatus 10.

During operation of the cutting assembly 16, the rectangular workpiece 14 is at least partially supported on a support table or structure 20. The support table 20 has transfer balls 22 which project upwardly and engage a flat lower side surface of the sheet metal workpiece 14 to hold the lower side surface in a horizontal plane. The transfer balls may be mounted and constructed in a manner similar to the one disclosed in U.S. Pat. No. 2,243,055. While the sheet metal workpiece 14 is supported on the table 20, it is held and moved by holders 24 having the same general construction as shown in U.S. Pat. No. 3,835,743.

During a cutting or work operation on the sheet metal workpiece 14, the holders 24 are moved along the axis designated Y in FIG. 1 by a cross slide 28. The cross slide 28 is movable toward and away from the sheet metal cutting assembly 16 along a pair of parallel guide rails 30 and 32. A drive motor 36 is connected with the cross slide 28 by a drive assembly which has been indicated schematically by dashed lines in FIG. 1.

The holders 24 are firmly mounted on a slider or carriage 40 which is movable along the X axis by a drive motor 42. The drive motor 42 is connected with the carriage 40 by a drive train which has been indicated schematically by dashed lines in FIG. 1. During operation of the motor 42, the carriage 40 is shifted along the cross slide 28 to change the position of the sheet metal workpiece 14 along the X axis. It should be noted that the holders 24 firmly grip the sheet metal workpiece 14 and hold it against movement relative to the carriage 40 as the position of the workpiece is changed along the perpendicular X and Y axes during operation of the motors 36 and 42.

In accordance with a feature of the present invention, the sheet metal workpiece 14 is accurately positioned relative to the holders 24 by a transverse gripper assembly 46 and longitudinal gripper assemblies 48. During operation of the sheet metal handling and cutting apparatus 10, a workpiece 14 is imprecisely positioned on the support table 20 at location indicated generally by dashed lines at **14*a* in FIG. 1. The transverse gripper assembly 46 then moves a rightward (as viewed in FIG. 1) edge 52 of the sheet metal workpiece into engagement with retractable stops 56 and 58 to accurately position the leading edge 52 of the workpiece 52 along the X axis. The longitudinal gripper assemblies 48 then move the workpiece 14 along the Y axis until the leading edge 62 of the workpiece is located in a desired position relative to the holders 24. The workpiece has then been located in the position indicated at 14*b* in FIG. 1**.

As the workpiece 14 is accurately positioned relative to the holders 24 along the Y axis, the leading edge 62 of the workpiece engages suitable stop surfaces connected with the holders 24. Thus, the gripper assemblies 46 and 48 cooperate with the retractable stops 56 and 58 and stop surfaces on the holders 24 to accurately position the workpiece relative to the holders. Once the workpiece has been accurately positioned relative to the holders 24, the gripper assemblies 46 and 48 and stop assemblies 56 and 58 are retracted. The cross slide 28 and carriage 40 are moved to index the workpiece relative to the sheet metal cutting apparatus 16.

During operation of the sheet metal cutting apparatus 16, the workpiece 14 is moved along the support table 20 by the cross slide 28 and carriage 40. Since the workpiece was initially accurately positioned relative to the holders 24, suitable numerical controls for the apparatus 10 can effect accurate positioning of the workpiece 14 relative to the sheet metal cutting apparatus 16. Of course, if the workpiece 14 was not initially positioned accurately relative to the holders 24, the workpiece could not subsequently be accurately indexed relative to the sheet metal cutting apparatus 16.

Figure 2:
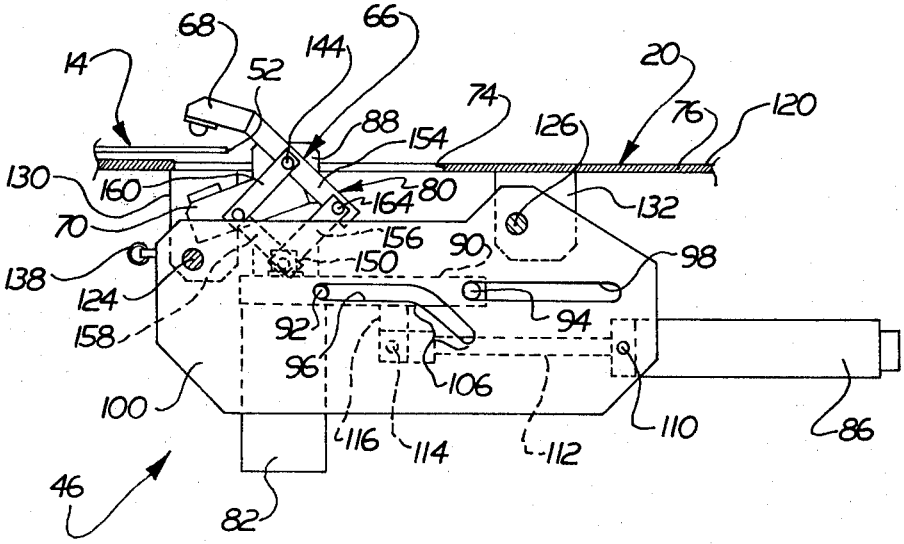
FIG. 2 is an elevational view, taken generally along the line 2—2 of FIG. 1, illustrating the construction of a gripper assembly which is used to position the workpiece, the gripper assembly being shown open and extended immediately prior to engagement of a workpiece by the gripper assembly.

The transverse gripper assembly 46 is illustrated in FIG. 2 in an open condition immediately prior to engagement of the workpiece 14 by the gripper assembly. At this time, the workpiece 14 is at the imprecisely defined loading location indicated in dashed lines at **14*a* in FIG. 1. The gripper assembly 46 includes a gripper mechanism 66 which is shown in an open condition in FIG. 2. The gripper mechanism 66 has upper and lower gripping pawls 68 and 70 which are spaced apart and disposed on opposite sides of a portion of the sheet metal workpiece 14 which extends over an opening 74 formed in an upper panel 76 of the support table 20**.

Figure 3:
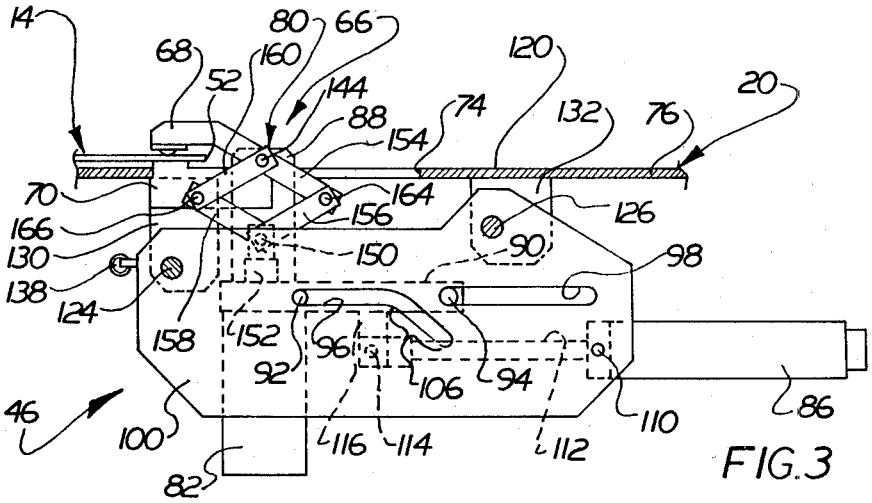
FIG. 3 is an elevational view, generally similar to FIG. 2, illustrating the gripper assembly engaging the workpiece.

The gripper mechanism 66 is operated from the open condition of FIG. 2 to the closed condition of FIG. 3 to firmly clamp the sheet metal workpiece 14 between the upper and lower gripper pawls 68 and 70. Thus, the gripper pawls 68 and 70 are connected with a four bar linkage 80 which is actuated by a piston and cylinder-type motor 82. Operation of the motor 82 simultaneously moves the upper pawl 68 downwardly (as viewed in FIG. 2) and moves the lower pawl 70 upwardly. The motor 82 applies a biasing force to maintain the gripper mechanism 66 in firm clamping engagement with the edge portion of the workpiece 14 as shown in FIG. 3. Although only a single transverse gripper assembly 46 has been shown, a plurality of transverse gripper assemblies could be provided if desired.

Once the workpiece 14 has been engaged by the gripper mechanism 66 in the manner shown in FIG. 3, the gripper mechanism is moved rightwardly along the X axis (see FIG. 1). This moves the leading edge 52 of the workpiece 14 into engagement with the stop assemblies 56 and 58. When the leading edge 52 of the workpiece 14 engages the stop assemblies 56 and 58, the leading edge of the rectangular workpiece is located in a predetermined desired position relative to the holders 24 and the X axis.

Figure 4:
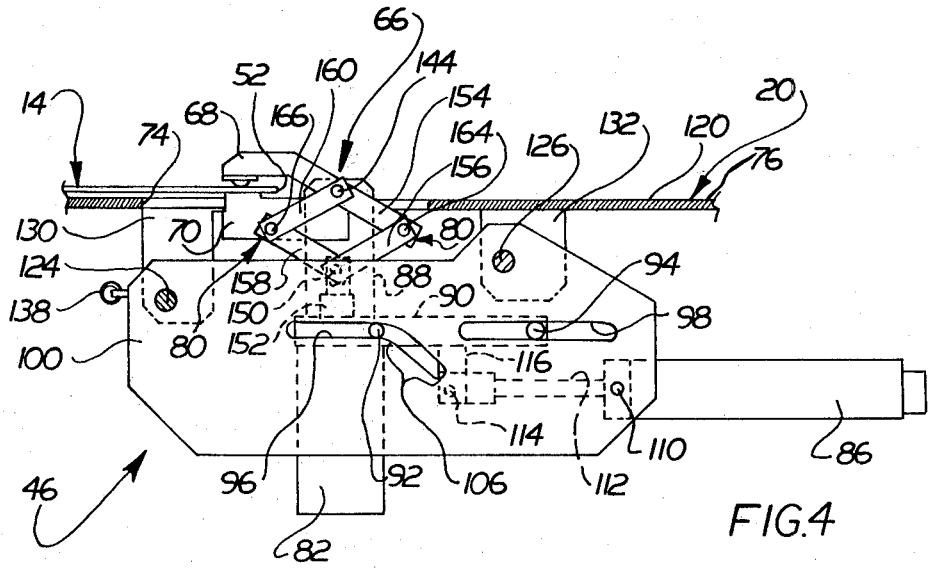
FIG. 4 is an elevational view of the gripper assembly of FIG. 2 after the workpiece has been moved to a predetermined position.

In order to move the edge 52 of the workpiece 14 into engagement with the stop assemblies 56 and 58, a piston and cylinder type motor 86 is operated to move the gripper mechanism 66 rightwardly from the position shown in FIG. 3 to the position shown in FIG. 4. When the gripper mechanism 66 reaches the position shown in FIG. 4, the leading edge 52 of the workpiece 14 is disposed in engagement with the stop assemblies 56 and 58. Operation of the motor 86 is then interrupted. However, the motor 86 is effective to maintain the edge 52 of the workpiece 14 at the desired position relative to the X axis.

To provide for movement of the gripper mechanism 66 from the position of initial engagement shown in FIG. 3 to the position shown in FIG. 4, the gripper mechanism 66 and the actuator motor 82 are mounted on a bracket 88 which is fixedly connected with a movable support member 90. The support member 90 is provided with a pair of outwardly projecting pins 92 and 94. The pins 90 and 94 are fixedly connected to the support member and extend into slots 96 and 98 formed in a support bracket or panel 100. Although only a single support panel or bracket 100 has been shown in FIGS. 3 and 4, it should be understood that a second support panel or bracket could be provided on the opposite side of the gripper assembly.

During rightward movement of the gripper mechanism 66 from the position shown in FIG. 3 to the position shown in FIG. 4, the support or guide pins 92 and 94 engage portions of the slots 96 and 98 which extend parallel to the horizontal upper panel 76 of the support table 20. Therefore, initial operation of the motor 86 causes the support member 90 to be pulled along a straight horizontal path which extends parallel to the X axis. This moves the gripper mechanism 66 and workpiece 14 from the position shown in FIG. 3 to the position shown in FIG. 4.

After the sheet metal workpiece 14 has been aligned with the Y axis (see FIG. 1) by the longitudinal gripper assembly 48, the gripper mechanism 66 in the transverse gripper assembly 46 is opened. The gripper assembly 46 is then moved to a retracted position beneath the upper panel 76 of the support table 20 (see FIG. 5). If desired, the gripper mechanism 66 could be closed while the gripper assembly 46 is in the retracted position. When the gripper assembly 46 is in the retracted position shown in FIG. 5, the workpiece 14 can be freely moved over the opening 74 through which the gripper assembly 46 previously extended. This enables the workpiece 14 to be moved to any desired position relative to the sheet metal cutting assembly 16.

Figure 5:
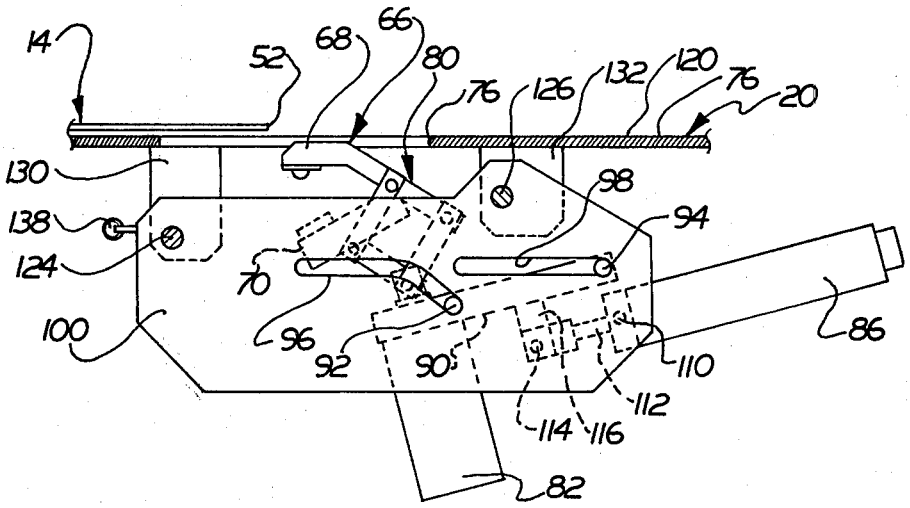
FIG. 5 is an elevational view illustrating the gripper assembly of FIGS. 2–4 in a retracted position.

When the gripper assembly 46 is to be moved from the retaining position shown in FIG. 4 to the retracted position shown in FIG. 5, the gripper mechanism 66 is first operated from the closed condition (FIG. 4) gripping the sheet metal workpiece 14 to the open condition (FIG. 5) by the gripper actuator motor 82. After the gripper mechanism 66 has been fully opened, the drive motor 86 is further retracted to move the gripper assembly 46 downwardly and toward the right from the position shown in FIG. 4 to the position shown in FIG. 5.

As the piston and cylinder type motor 86 is operated to retract the gripper assembly 46, the support pin 92 engages a downwardly and rightwardly sloping portion 106 (see FIG. 4) of the guide slot 96. This results in the movable support member 90 being pivoted about the support pin 94 which is disposed in the straight horizontal slot 98. During this pivoting movement of the support member 90 about the pin 94, the pin is moving toward the right (as viewed in FIGS. 4 and 5) along the horizontal slot 98. As the movable support member 90 pivots in a counterclockwise direction about the support pin 94 and is moved toward the right (as viewed in FIGS. 4 and 5), the gripper mechanism 66 is swung downwardly and rightwardly from the position shown in FIG. 4 to the position shown in FIG. 5.

As the support member 90 pivots about the pin 94, the motor 86 pivots about a support pin 110. The support pin 110 is connected with one end of the motor 86 and the support bracket or panel 100. The motor 86 has a piston rod 112 which is pivotally connected at 114 with a downwardly extending projection 116 which is fixedly connected with the movable support member 90.

When the gripper mechanism 66 is in the fully retracted position of FIG. 5, the upper pawl 68 of the gripper mechanism 66 is disposed below an upper side surface 120 of the support table 20. Therefore, the workpiece 14 can be moved rightwardly from the position shown in FIG. 5 without interfering with the gripper assembly. This allows the holder 24 to move relative to the cutting apparatus 16 and stationary support table 20 without interference with the gripper assembly 46.

After the sheet metal workpiece 14 has been moved into alignment with the X axis by the gripper assembly 46, the workpiece is moved into alignment with the Y axis by the gripper assemblies 48. Although the construction of only the gripper assembly 46 has been shown in FIGS. 2–5, the gripper assemblies 48 have the same construction as previously described for the gripper assembly 46. The only difference between the gripper assemblies 48 and the gripper assemblies 46 is the manner in which the gripper assembly 46 is mounted on the support table 20.

The gripper assembly 46 remains in firm clamping engagement with the workpiece 14 during movement of the workpiece along the Y axis by the gripper assemblies 48. Therefore, it is necessary for the gripper assembly 46 to move along the Y axis with the sheet metal workpiece 14 as the workpiece is moved by the gripper assemblies 48. To accommodate this movement of the gripper assembly 46 along the Y axis with the sheet metal workpiece 14, the support bracket or panel 100 for the gripper assembly 46 is slidably mounted on a pair of horizontal support rods 124 and 126 which extend parallel to the Y axis. The support rods 124 and 126 are fixedly secured to the upper panel 76 of the support table 20 by a pair of downwardly projecting support arms or brackets 130 and 132 (see FIG. 5).

During movement of the sheet metal workpiece 14 by the gripper assemblies 48 along a path extending parallel to the Y axis and perpendicular to the X axis, the workpiece is effective to pull the gripper assembly 46 along the support rods 124 and 126 toward the X axis. During this movement of the gripper assembly 46 and workpiece 14 toward the X axis, the gripper assembly remains in the closed condition shown in FIG. 4. Therefore, the edge 52 of the workpiece 14 remains in the same position along the X axis as the workpiece moves along the Y axis.

When the edge 62 (see FIG. 1) of the workpiece 14 abuts stop surfaces on the holders 24, the workpiece 14 is in a desired position relative to the Y axis. Since the workpiece was previously moved to the desired position relative to the X axis by the gripper assembly 46, the holders 24 can be closed to firmly clamp the workpiece 14 with the workpiece precisely positioned relative to the holders.

Once the sheet metal workpiece 14 has been properly positioned relative to the X and Y axes by the gripper assemblies 46 and 48, the holders 24 are closed to firmly grip the workpiece. The gripper assemblies 46 and 48 are then disengaged from the workpiece 14 and are moved to their retracted positions. When the gripper assemblies 48 are in their retracted positions, they are disposed below the upper surface 120 of the support table in the same manner as illustrated in FIG. 5, for the gripper assembly 46.

The gripper assembly 46 is provided with a biasing spring 138 which applies a force to the support panel or bracket 100. The biasing force pulls the gripper assembly 46 back along the support rods 124 and 126 to its original position. Thus, when the gripper assembly 46 is operated from the closed condition of FIG. 4 to the open condition of FIG. 5 prior to movement of the gripper assembly 46 to the retracted position, the spring 138 moves the gripper assembly along the guide rails 124 and 126 away from the X axis in a direction parallel to the Y axis. This movement of the gripper assembly 46 is sufficient to return it to the position from which it was moved by movement of the workpiece 14 along the Y axis.

It should be understood that the construction of the gripper assemblies 48 is the same as the construction of the gripper assembly 46. However, the gripper assemblies 48 are fixedly connected with the upper panel 76 of the support table 20 by downwardly projecting mounting brackets or arms which correspond to the mounting brackets or arms 130 and 132 (FIG. 5). The gripper assemblies 48 are fixedly connected with these downwardly projecting arms or support brackets and do not move along rods, similar to the rods 124 and 126, as do the gripper assemblies 46. Of course the orientation of the gripper assemblies 48 is offset by ninety degrees from the orientation of the gripper assembly 46 to enable the gripper assemblies 48 to move the workpiece along the Y axis upon operation of drive motors corresponding to the drive motor 86.

The gripper assemblies 46 and 48 each include a gripper mechanism corresponding to the gripper mechanism 66 of FIGS. 2–5. The gripper mechanism 66 includes the four bar linkage 80 which is actuated by the motor 82 (see FIG. 3). The four bar linkage 80 is connected with a fixed pivot pin 144 which is mounted on the upwardly projecting arm or bracket 88. The bracket 88 is fixedly connected with the movable support member 90 and the motor 82. Directly beneath the fixed pivot pin 144 is a movable pivot pin 150 which is connected with a piston rod 152 of the motor 82. Therefore, upon retraction of the piston rod 152 from the extended position shown in FIG. 3 to a retracted position (see FIG. 2) the pivot pin 150 moves downwardly to actuate the four bar linkage 80.

Connected with the pivot pins 144 and 150 are links 154, 156, 158, and 160. The links 154 and 156 are pivotally interconnected by a pivot pin 164. Similarly, the links 158 and 160 are pivotally interconnected by a pivot pin 166. The upper pawl 68 of the gripper mechanism 66 is formed as a continuation of the link 154. The lower pawl 70 of the gripper mechanism 66 is connected with the fixed pivot pin 144 and the movable pivot pin 166.

Upon actuation of the motor 82 to operate the gripper mechanism 66 from the closed condition of FIG. 3 to the open condition of FIG. 2, the movable pivot pin 150 is pulled downwardly by retraction of the piston rod 152. This results in the various links 154, 156, 158 and 160 of the four bar linkage 80 pivoting about the fixed pin 144, the movable pin 150 and the two interconnecting movable pins 164 and 166. As this occurs, the upper pawl 68 pivots in a clockwise direction about the fixed pivot pin 144 and the lower pawl 70 pivots in a counterclockwise direction about the pivot pin 144. Of course, when the motor 82 is operated to extend the piston rod 152 from the retracted position of FIG. 2 to the extended position of FIG. 3, the gripper mechanism 66 is closed.

During operation of the sheet metal handling and cutting apparatus 10 (see FIG. 1) it is contemplated that the position in which the workpiece 14 is initially placed on the support table 22 will vary along the X and Y axes. Therefore, the distance which the gripper assemblies 46 and 48 must move the workpiece 14 along the X and Y axes to locate it in a desired position relative to the holders 24 will vary. Therefore, the motor 86 in the gripper assemblies 46 and 48 cannot be operated to move the workpiece 14 through a predetermined distance between the location at which a workpiece is initially gripped (FIG. 3) and a location where the workpiece is released (FIG. 4).

Figure 6:
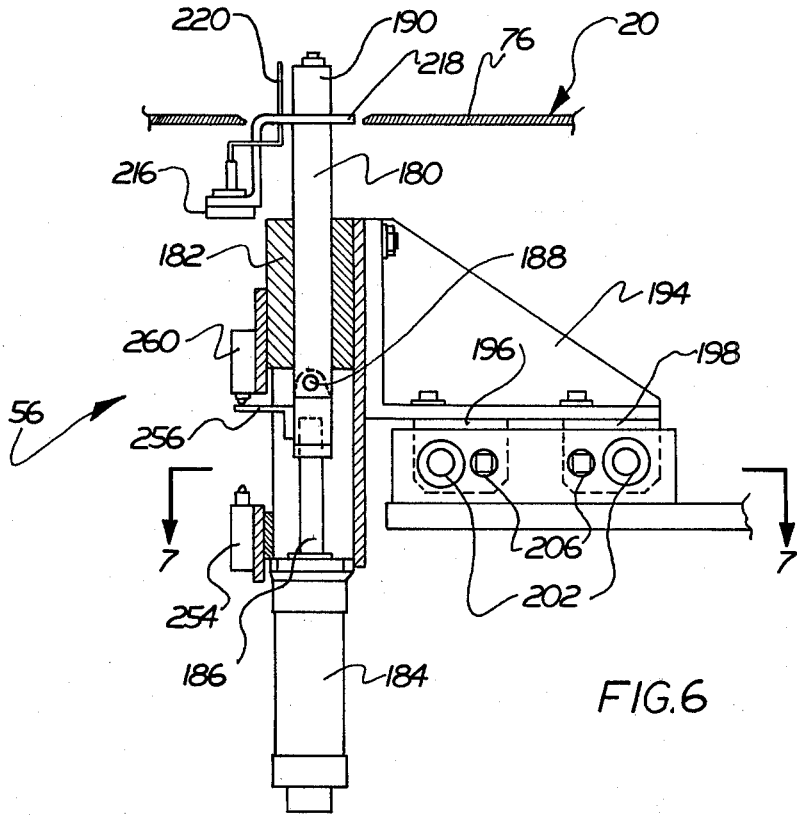
FIG. 6 is an elevational view, taken generally along the line 6—6 of FIG. 1, illustrating the construction of a retractable stop assembly which is engaged by the leading edge of a sheet material workpiece when it is in a predetermined position, the stop assembly being shown in an extended position in FIG. 6.

In order to provide for accurate locating of the workpiece relative to the X axis, the retractable stop assemblies 56 and 58 engage the rightward (as viewed in FIG. 1) edge 52 of the workpiece 14 when it has been moved to a predetermined position along the X axis. The stop assembly 56 (see FIG. 6) includes a vertically extending cylindrical stop member or rod 180 which is slidably disposed in a guide sleeve 182. A piston and cylinder motor 184 has a piston rod 186 which is connected with the stop rod 180 at a pivot pin 188. Upon actuation of the motor 184, the stop rod 180 is moved between the extended position shown in FIG. 6 and the retracted position in which an upper end portion 190 of the stop rod is disposed beneath the upper panel 76 of the support table 20.

Figure 7:
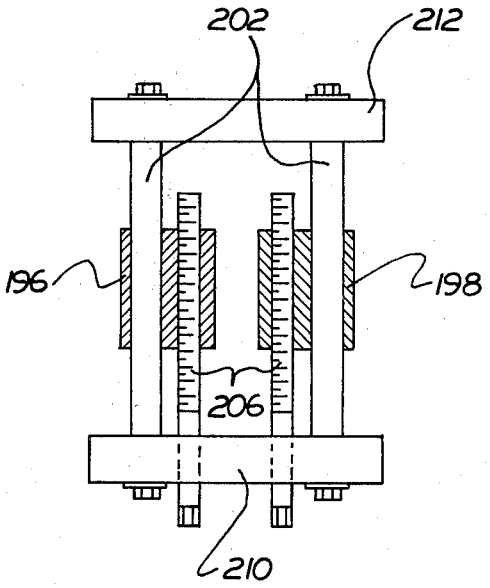
FIG. 7 is a plan view, taken generally along the line 7—7 of FIG. 6, illustrating the construction of an arrangement for adjusting the position of the stop assembly.

The motor 184 and stop rod 180 are fixedly connected with a carriage or bracket 194 having downwardly extending support sections 196 and 198 which slidably engage a pair of horizontal support rods 202 (see FIGS. 6 and 7) which extend parallel to the X axis. A pair of adjusting screws 206 are connected with downwardly extending support flanges 196 and 198 and a stationary mounting bracket 210 of a pair of mounting brackets 210 and 212. Upon rotation of the screws 206, the retractable stop assembly 56 is shifted along the X axis in a direction perpendicular to the Y axis, to adjust the position of the retractable stop assembly.

A detector switch 216 is mounted on the upper end of the stop rod 180 by a support arm 218 which is fixedly connected with the stop rod. The switch 216 is actuated upon engagement of the end 52 of a sheet metal workpiece 14 with an upwardly projecting feeler or actuator arm 220. Thus, when the edge of a sheet metal workpiece has been moved to a predetermined position relative to the X axis, the edge of the workpiece engages the stop rod 180 and the feeler 220. This actuates the switch 216 to provide an indication that the edge of the workpiece is in a desired location relative to the X axis. Suitable control circuitry then effects operation of the gripper assemblies 48 to position the workpiece relative to the Y axis.

When the workpiece 14 has been moved to a predetermined position relative to the Y axis, the edge 62 of the workpiece engages suitable stop surfaces mounted on the holders 24. Since the stop surfaces are mounted on the holders 24, it is not necessary to provide separate stop assemblies, similar to the stop assemblies 56 and 58, to limit movement of the sheet metal workpiece along the Y axis. However, if desired, separate stop assemblies, similar to the stop assemblies 56 and 58 could be provided to limit movement of the workpiece along the Y axis.

Figure 8:
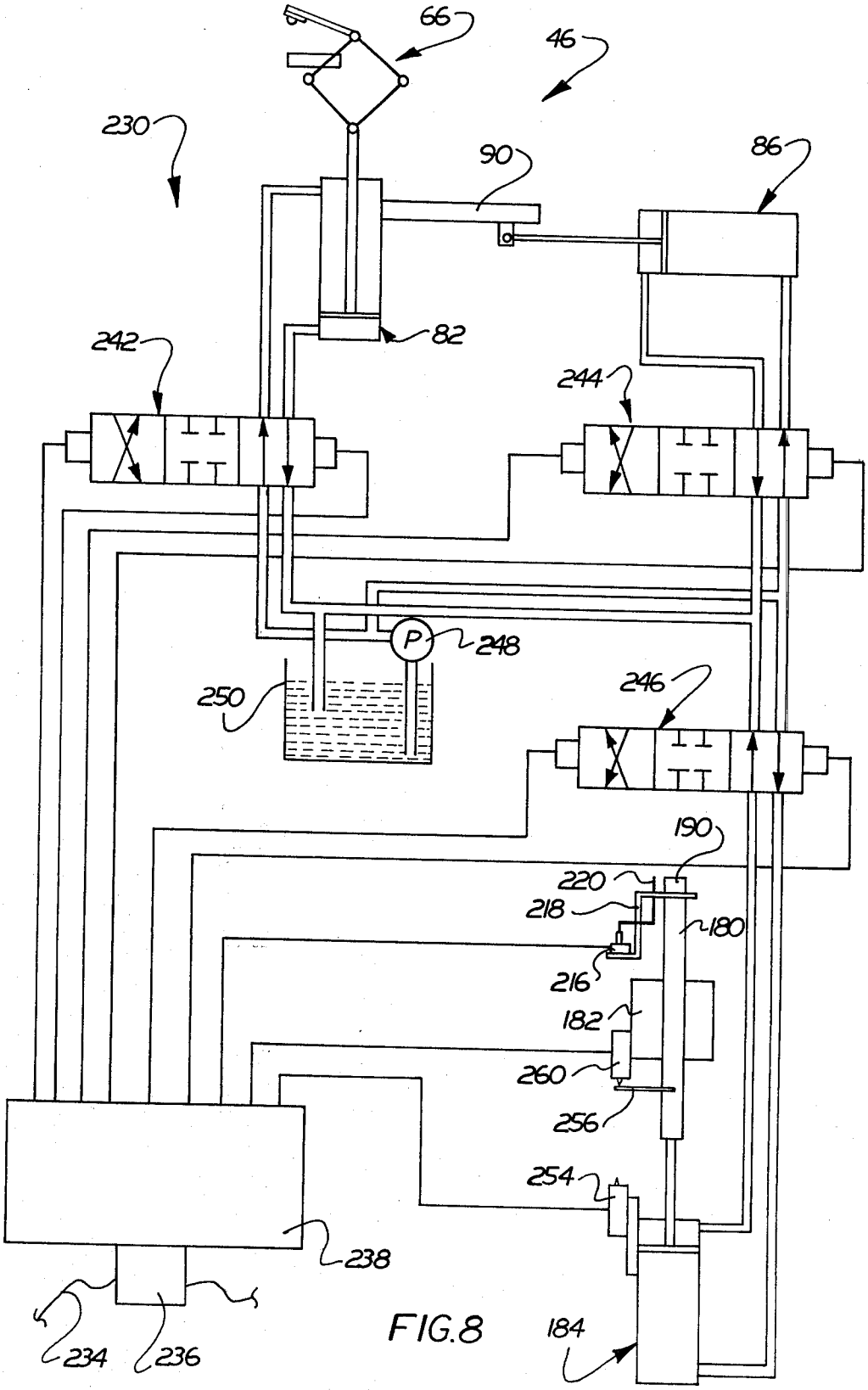
FIG. 8 is a highly schematicized drawing of control circuitry which is used with the apparatus of FIG. 1.

Control circuitry for the gripper assemblies 46 and 48 and the stop assemblies 56 and 58 is illustrated schematically in FIG. 8. Although many different types of control circuits could be utilized, in the embodiment illustrated schematically in FIG. 8, the control circuitry is operated in accordance with a predetermined program punched on a tape 234 which is read by a reader 236. The reader 236 activates control apparatus 238 to control the operation of the gripper assemblies 46 and 48 and stop assemblies 56 and 58 in accordance with the program on the tape 234. Of course, other known types of control circuits and data storage devices could be used if desired.

The control circuitry 238 is connected with valves which control the operation of the gripper assemblies 46 and 48. Thus, a valve 242 which is actuated to effect operation of the motor 82 in the gripper assembly 46. The drive motor 86 in the gripper assembly is operated in response to actuation of a valve 244. The motor 184 for raising or lowering the stop rod 180 is operated in response to actuation of the valve 246. The valves 242, 244 and 246 are connected with a pump 248 and a reservoir 250. Valves (not shown) similar to the valves 242 and 244 are provided to control the operation of motors in the gripper assemblies 48.

The control circuitry 230 has been shown in FIG. 8 in a condition immediately prior to engagement of the gripper assembly 46 with a sheet metal workpiece. At this time, the valve 242 is actuated to port fluid under pressure to the rod end of the motor 82 to retract a piston and operate the gripper mechanism 66 to the open condition shown in FIG. 2. The valve 244 (FIG. 8) is actuated to port fluid under pressure to the head end of the motor 86 to hold the gripper assembly 46 in leftward position (as viewed in FIG. 2). Finally, the valve 246 (FIG. 8) is actuated to port fluid under pressure to the head end of the motor 184 to raise the stop member 180.

After the sheet metal workpiece 14 has been placed on the support table 22, the control apparatus 238 effects operation of the valve 242 to port high pressure fluid to the head end of the motor 82 to operate the gripper mechanism 66 from the open condition shown in FIG. 2 to the closed condition shown in FIG. 3 to firmly grip the workpiece. The valve 244 is then operated to port high pressure fluid to the rod end of the motor 86 and move the gripper mechanism 66 rightwardly toward the position shown in FIG. 4. As the motor 86 moves the gripper mechanism 66, the leading edge 52 of the sheet metal workpiece 52 approaches and engages the stop member 180. As this occurs, the feeler 220 is actuated to operate the switch 216 and provide a signal to the control apparatus 238 indicating that the workpiece has engaged the stop member 180. When this occurs, the valve 244 is operated to a centered position in which the motor 86 is hydraulically locked to hold the gripper mechanism 66 against movement along the X axis. It should be noted that the valve 242 remains actuated porting high pressure fluid to the head end of the motor 82 to maintain the gripper mechanism 66 in tight clamping engagement with the sheet metal workpiece.

The control apparatus 238 then effects actuation of a pair of valves, not shown but similar to the valve 242, to close the gripper assemblies 48 on the sheet metal workpiece 14. Once the sheet metal workpiece has been firmly clamped by the gripper assemblies 48, the drive motors, similar to the drive motor 86, are operated by actuation of suitable control valves, not shown but similar to the valve 244, to move the edge of the workpiece 62 into engagement with stop surfaces on the holders 24.

During movement of the workpiece 14 along the Y axis under the influence of the gripper assemblies 48, the gripper assembly 46 maintains firm clamping engagement with the workpiece to hold it in the desired position relative to the X axis. Once the workpiece has engaged the stop surfaces on the holders 24, the gripper mechanisms and the gripper assemblies 46 and 48 are opened. Thus, the valve 242 is actuated to port high pressure fluid to the rod end of the motor 82. High pressure fluid is also ported to the rod end of the gripper actuator motor in the gripper mechanisms 48 to open these gripper mechanism. Upon opening of the gripper mechanism 46, the gripper mechanism is moved along the Y axis in a direction away from the X axis by the biasing spring 138 to return the gripper assembly 46 to its initial position from which it was pulled during movement of the workpiece 14 along the Y axis toward the X axis.

After the gripper assemblies 46 and 48 have been opened, the gripper assemblies and stop assemblies 56 and 58 are retracted below the upper surface of the support table 20 to enable the workpiece 14 to be moved freely across the upper surface of the support table by the holders 24. Thus, after the gripper assemblies 46 and 48 have been opened, the numerical control apparatus 238 effects operation of the valve 244 to port high pressure fluid to the rod end of the motor 86 to move the gripper assembly 66 from the position shown in FIG. 4 to the retracted position shown in FIG. 5. If desired, the valve 242 could be actuated at this time to operate the motor 82 to close the gripper mechanism 66.

The stop assembly 56 is retracted by effecting actuation of a valve 246 to port high pressure fluid to the rod end of the motor 184. This moves the stop rod 180 vertically downwardly. When the stop rod 180 is fully retracted, a limit switch 254 is actuated by a sensing piece or arm 256 to provide a signal to the control apparatus 238 that the stop rod 180 has been fully retracted. Similarly, when the stop rod 180 is to be extended, a limit switch 260 is actuated by the arm 256.

In view of the foregoing, it is apparent that the present invention provides a method and apparatus for precisely positioning a sheet material workpiece 14 relative to holders 24 which are used to grip and move the workpiece. The apparatus includes table 20 upon which the workpiece is supported. The holders 24 are disposed on a carriage 40 which is movable mounted on a cross slide 28. The carriage 40 and cross slide 28 are moved relative to a shearing machine or punch press 16 to move the holders 24 and position the workpiece for cutting operations.

In accordance with the present invention, the sheet metal workpiece 14 is accurately positioned relative to the holders 24 by a plurality of gripper assemblies 46 and 48. When a workpiece 14 is placed on the support table 20, a transverse gripper assembly 46 is moved from a retracted position (FIG. 5) disposed beneath an upper surface 120 of the support table 20 to an extended position (FIG. 2) in which it can engage an edge portion of the sheet material workpiece. The transverse gripper assembly 46 then pulls the workpiece along a path extending parallel to a first or X axis. When the workpiece is moved to a predetermined position relative to the X axis, a leading edge 52 of the workpiece engages a stop 56, 58. A second or longitudinal gripper assembly 48 is movable from a retracted position beneath the upper surface 120 of the support table 20 to an extended position in which it engages a second edge portion of the workpiece. The longitudinal gripper assembly 48 then moves the workpiece 14 relative to the holders 24 to a predetermined position along a second or Y axis.

The longitudinal and transverse gripper assemblies 46 and 48 each include a drive motor 86 which moves the gripper assembly 46 or 48 from a retracted position (FIG. 5) to an extended position (FIG. 2). Once the gripper assembly 46 or 48 has been moved to an extended position, a gripper actuator motor 82 operates a gripper mechanism 66 from an open condition to a closed condition (FIG. 3) to firmly grip a sheet material workpiece 14. The drive motor 86 then moves the gripper assembly 46 or 48 along a path extending parallel to the uppersurface of the support table until a leading edge of the sheet material workpiece is at a predetermined position relative to the holders 24. After the workpiece has been aligned with the holders 24, the gripper assembly 46 or 48 is operated to an open condition. Then the drive motor 86 is again operated to move the gripper assembly 46 or 48 back to the retracted position beneath the upper surface 120 of the support table 20.

Although the gripper assemblies 46 and 48 could be operated simultaneously or in different sequences, the transverse gripper assembly 46 is used to move the workpiece 14 along the X axis. Thereafter, the longitudinal gripper assembly 48 is used to move the workpiece 14 along the Y axis.

As the workpiece 14 is moved into a predetermined position along the X axis by the transverse gripper assembly 46, a leading edge 52 of the workpiece engages a retractable stop 56 or 58 and actuates a detector 216 which causes the longitudinal gripper assembly 48 to engage the second end portion of the sheet material workpiece 14. The longitudinal gripper assembly 48 then moves the workpiece along the Y axis to complete the positioning of the workpiece relative to the holders. During movement of the workpiece along the Y axis by the longitudinal gripper assembly 48, the workpiece is gripped by the transverse gripper assembly 46 which moves with the workpiece to hold it in position along the X axis.

Once the workpiece has been moved to a predetermined position relative to the X and Y axes, the holder 24 engages the workpiece. The gripper assemblies 46, 48 are then opened and moved to retracted positions beneath the upper surface of the support table.

Having described one specific preferred embodiment of the invention, the following is claimed:

1. An apparatus comprising cutter means for cutting sheet material workpieces, support means for at least partially supporting a sheet material workpiece, said support means including means for at least partially defining a plurality of openings, movable holder means for holding the sheet material workpiece during movement of the workpiece relative to said support means and during cutting of the workpiece by said cutter means, means for moving said holder means relative to said support means along first and second transverse axes to change the position of the sheet material workpiece held by said holder means relative to said cutter means, and positioning means for positioning the sheet material workpiece relative to said holder means, said positioning means including first gripper means disposed in one of the openings in said support means for gripping the sheet material workpiece and moving the sheet material workpiece relative to said support means and said holder means to a predetermined position along the first axis and second gripper means disposed in another of the openings in said support means for gripping the sheet material workpiece and moving the workpiece relative to said support means and said holder means to a predetermined position along the second axis.

2. An apparatus as set forth in claim 1 wherein said support means includes means for supporting a sheet material workpiece with a lower side surface of the workpiece disposed in a first plane, said first gripper means including means for moving said first gripper means relative to said support means between a retracted position in which said first gripper means is disposed below said first plane and an extended position in which said first gripper means extends above said first plane, said second gripper means including means for moving said second gripper means relative to said support means between a retracted position in which said second gripper means is disposed below said first plane and an extended position in which said second gripper means extends above said first plane.

3. An apparatus as set forth in claim 2 wherein said first gripper means includes first motor means for operating said first gripper means from an open condition to a closed condition when said first gripper means is in the extended position to grip the workpiece with said first gripper means, said second gripper means including second motor means for operating said second gripper means from an open condition to a closed condition when said second gripper means is in the extended position to grip the workpiece with said second gripper means.

4. An apparatus as set forth in claim 1 wherein said second gripper means includes means for moving the workpiece and said first gripper means relative to said support means along the second axis while said first gripper means is gripping the workpiece.

5. An apparatus as set forth in claim 4 further including guide means for guiding movement of said first gripper means along the second axis while maintaining the position of said first gripper means along the second axis constant during movement of said first gripper means along the second axis.

6. An apparatus as set forth in claim 1 further including stop means for limiting movement of the workpiece along the first axis by said first gripper means.

7. An apparatus as set forth in claim 1 wherein said support means includes means for supporting a sheet material workpiece with a lower side surface of the workpiece disposed in a first plane, said first gripper means including a gripper assembly which is operable between an open condition and a closed condition in which said gripper assembly is effective to grip a sheet material workpiece, means for supporting said gripper assembly for movement along the first axis between a first position and a second position in which the workpiece is in the predetermined position relative to the first axis and for supporting said gripper assembly for movement from the second position to a retracted position, said gripper assembly extending above said first plane when said gripper assembly is in the first and second positions and being disposed below said first plane when said gripper assembly is in the retracted position, and a single motor connected with said gripper assembly and operable to move said gripper assembly relative to said support means from the first position through the second position to the retracted position.

8. An apparatus as set forth in claim 7 further including motor means connected with said gripper assembly for operating said gripper assembly between the open and closed conditions, said motor means being movable with said gripper assembly from the first position through the second position to the retracted position.

9. An apparatus comprising cutter means for cutting sheet material workpieces, support means for at least partially supporting a sheet material workpiece, movable holder means for holding the sheet material workpiece during cutting of the workpiece by said cutter means, means for moving said holder means relative to said support means to change the position of the sheet material workpiece held by said holder means relative to said cutter means, and positioning means for positioning the sheet material workpiece relative to said holder means, said positioning means including first gripper means for gripping the sheet material workpiece and moving the workpiece in a first direction relative to said support means and said holder means and second gripper means for gripping the workpiece and moving the workpiece in a second direction relative to said support means and said holder means, said second gripper means including means for moving the sheet material workpiece and said first gripper means in the second direction relative to said support means while said first gripper means is gripping the workpiece.

10. An apparatus as set forth in claim 9, further including biasing means for applying a force to said first gripper means to move said first gripper means in a direction opposite to said second direction upon operation of said first gripper means to release the sheet material workpiece.

11. An apparatus as set forth in claim 10 further including guide means for guiding movement of said first gripper means in the second direction under the influence of said second gripper means and for guiding movement of said first gripper means in the direction opposite to the second direction under the influence of said biasing means.

12. An apparatus as set forth in claim 9 further including stop means engageable with the sheet material workpiece to limit movement of said first gripper means in the first direction, detector means for detecting engagement of the sheet material workpiece with said stop means, and control means for initiating operation of said second gripper means to move the sheet material workpiece in the second direction in response to detection of engagement of the workpiece with said stop means.

13. An apparatus comprising cutter means for cutting sheet material workpieces, support means for at least partially supporting a sheet material workpiece, said support means including means for supporting a sheet material workpiece with a lower side surface of the workpiece disposed in a first plane, movable holder means for holding the workpiece during cutting of the workpiece by said cutter means, means for moving said holder means relative to said support means to change the position of the sheet material workpiece held by said holder means relative to said cutter means, and positioning means for positioning the sheet material workpiece relative to said holder means, said positioning means including first gripper means for gripping the sheet material workpiece and moving the workpiece relative to said support means and said holder means and second gripper means for gripping the workpiece and moving the workpiece relative to said support means and said holder means, said first gripper means including a first gripper assembly operable between open and closed conditions, first motor means for moving said first gripper assembly between a retracted position in which said first gripper assembly is disposed below the first plane and an extended position in which said first gripper assembly extends above the first plane, and second motor means for operating said first gripper assembly from the open condition to the closed condition when said first gripper assembly is in the extended position, said second gripper means including a second gripper assembly operable between open and closed conditions, third motor means for moving said second gripper assembly between a retracted position in which said second gripper assembly is disposed below the first plane and an extended position in which said second gripper assembly extends above the first plane, and fourth motor means for operating said second gripper assembly from the open condition to the closed condition when said second gripper assembly is disposed in the extended position.

14. An apparatus as set forth in claim 13 wherein said first gripper means includes first track means for guiding movement of said first gripper assembly between retracted and extended positions under the influence of said first motor means, said second gripper means includes second track means for guiding movement of said second gripper assembly between retracted and extended positions under the influence of said third motor means, said first track means extending transversely to said second track means so that said first and third motor means are operable to move said first and second gripper assemblies along transversely extending paths.

15. An apparatus as set forth in claim 14 further including means for interrupting operation of said first motor means and movement of said first gripper assembly along said first track means when said first gripper assembly is in an intermediate position between the extended and retracted positions, said first gripper assembly extending above the first plane when said first gripper assembly is in the intermediate position, and means for effecting operation of said second motor means to operate said first gripper assembly from the closed condition to the open condition when said first gripper assembly is in the intermediate position.

16. An apparatus as set forth in claim 15 further including means for interrupting operation of said third motor means and movement of said second gripper assembly along said second track means when said second gripper assembly is in an intermediate position between the extended and retracted positions, said second gripper assembly extending above the first plane when said second gripper assembly is in the intermediate position, and means for effecting operation of said fourth motor means to operate said second gripper assembly from the closed condition to the open condition when said second gripper assembly is in the intermediate position.

17. An apparatus as set forth in claim 16 further including means for supporting said first gripper means for movement along a path extending transversely to said first track means and parallel to said second track means, said third motor means being effective to move said first gripper means along the path extending transversely to said first track means and parallel to said second track means upon operation of said third motor means to move said second gripper assembly along said second track means from the extended position to the intermediate position.

18. An apparatus comprising cutter means for cutting a sheet material workpiece, support means for at least partially supporting the sheet material workpiece, said support means including means for supporting a sheet material workpiece with upper and lower side surfaces of the workpiece disposed in first and second planes, movable holder means for holding the sheet material workpiece during cutting of the sheet material workpiece by said cutter means, a stop member disposed at a central portion of the support structure, means for moving said stop member between a first position in which said stop member extends through the first and second planes and a second position in which said stop member is spaced from the first and second planes, first gripper means disposed at the central portion of the support structure for gripping a first edge portion of the sheet material workpiece and moving the first edge portion of the sheet material workpiece into engagement with said stop member when said stop member is in the first position, said first gripper means being movable between a first position in which said first gripper means extends through the first and second planes and a second position in which said first gripper means is spaced from the first and second planes, second gripper means for gripping a second edge portion of the sheet material workpiece and moving the workpiece relative to said support means to a predetermined position relative to said holder means, means for effecting operation of said holder means to grip the second edge portion of the workpiece when the workpiece is in the predetermined position, and means for moving said holder means relative to said support means to move the sheet material workpiece across the central portion of said support means while said stop member and said first gripper means are in their second position to thereby change the position of the sheet material workpiece relative to said cutter means.

19. An apparatus as set forth in claim 18 wherein said second gripper means is movable relative to said support means between a first position in which said second gripper means extends through the first and second planes and a second position in which said second gripper means is spaced from the first and second planes.

20. An apparatus as set forth in claim 19 wherein said first gripper means includes first motor means for operating said first gripper means from an open condition to a closed condition when said first gripper means is in the first position to grip the workpiece with said first gripper means, said second gripper means including second motor means for operating said second gripper means from an open condition to a closed condition when said second gripper means is in the first position to grip the workpiece with said second gripper means.

21. An apparatus as set forth in claim 18 wherein said second gripper means includes means for moving the workpiece and said first gripper means relative to said support means while said first gripper means is gripping the workpiece.

22. A method for operating an apparatus to cut sheet material workpieces, said method comprising the steps of positioning a sheet material workpiece on a support structure adjacent to a holder assembly, gripping a first edge portion of the workpiece with a first gripper assembly which is disposed at a central portion of the support structure, moving the first edge portion of the workpiece into engagement with a stop member disposed at a central portion of the support structure by moving the first gripper assembly in a first direction relative to the holder assembly and support structure while the first edge portion of the workpiece is gripped by the first gripper assembly, gripping a second edge portion of the workpiece with a second gripper asembly, moving the second gripper assembly relative to the holder assembly and support structure in a second direction transverse to the first direction while the workpiece is gripped by the second gripper assembly, gripping the second edge portion of the workpiece with the holder assembly after having performed said steps of moving the first gripper assembly and moving the second gripper assembly, disengaging the first gripper assembly from the workpiece, disengaging the second gripper assembly from the workpiece, moving the first gripper assembly and the stop member to locations spaced from planes containing upper and lower side surfaces of the workpiece, and moving the workpiece across the central portion of the support structure by moving the holder assembly after having performed said step of moving the first gripper assembly and the stop member to locations spaced from the planes of the upper and lower side surfaces of the workpiece.

23. A method as set forth in claim 22 wherein said step of gripping the workpiece with the first gripper assembly is performed while performing said steps of gripping the workpiece with the second gripper assembly and moving the second gripper assembly to effect movement of the first gripper assembly relative to the support structure with the workpiece and the second gripper assembly.

24. A method for operating an apparatus to cut sheet material workpieces, said method comprising the steps of positioning a sheet material workpiece on a support structure adjacent to holder assemblies, gripping the workpiece with a first gripper assembly, moving the first gripper assembly relative to the holder assemblies and support structure while the workpiece is gripped by the first gripper assembly, gripping the workpiece with a second gripper assembly, moving the second gripper assembly relative to the holder assembly and support structure while the workpiece is gripped by the second gripper assembly, gripping the workpiece with the holder assemblies after having performed said steps of moving the first gripper assembly and moving the second gripper assembly, said step of gripping the workpiece with the first gripper assembly is performed while performing said steps of gripping the workpiece with the second gripper assembly and moving the second gripper assembly to effect movement of the first gripper assembly relative to the support structure with the workpiece and the second gripper assembly, disengaging the first gripper assembly from the workpiece, disengaging the second gripper assembly from the workpiece, and moving the workpiece relative to the support structure by moving the holder assemblies after having performed said steps of disengaging the first and second gripper assemblies from the workpiece and gripping the workpiece with the holder assemblies.

25. A method as set forth in claim 24 wherein said step of positioning the workpiece on a support structure includes the step of positioning the workpiece on the support structure with a lower side surface of the workpiece disposed in a first plane, said step of gripping the workpiece with a first gripper assembly being performed with the first gripper assembly extending above the first plane, said method further including the step of moving the first gripper assembly to a position below the first plane after disengaging the first gripper assembly from the workpiece.

26. A method as set forth in claim 25 wherein said step of gripping the workpiece with a second gripper assembly is performed with the second gripper assembly extending above the first plane, said method further including the step of moving the second gripper assembly to a position below the first plane after disengaging the second gripper assembly from the workpiece.

27. A method for operating an apparatus to cut sheet material workpieces, said method comprising the steps of positioning a sheet material workpiece on a support structure adjacent to holder assemblies, said step of positioning the workpiece on a support structure includes the step of positioning the workpiece on the support structure with a lower side surface of the workpiece disposed in a first plane, gripping the workpiece with a first gripper assembly, said step of gripping the workpiece with a first gripper assembly being performed with the first gripper assembly extending above the first plane, moving the first gripper assembly relative to the holder assemblies and support structure while the workpiece is gripped by the first gripper assembly, gripping the workpiece with a second gripper assembly, moving the second gripper assembly relative to the holder assembly and support structure while the workpiece is gripped by the second gripper assembly, gripping the workpiece with the holder assemblies after having performed said steps of moving the first gripper assembly and moving the second gripper assembly, disengaging the first gripper assembly from the workpiece, moving the first gripper assembly to a position below the first plane after disengaging the first gripper assembly from the workpiece, disengaging the second gripper assembly from the workpiece, and moving the workpiece relative to the support structure by moving the holder assemblies after having performed said steps of disengaging the first and second gripper assemblies from the workpiece and gripping the workpiece with the holder assemblies.

28. A method as set forth in claim 27 wherein said step of disengaging the first gripper assembly from the workpiece is performed after performance of said steps of gripping the workpiece with the second gripper assembly and moving the second gripper assembly relative to the holder assembly and the support structure.

29. A method as set forth in claim 27 wherein said step of gripping the workpiece with a second gripper assembly is performed with the second gripper assembly extending above the first plane, said method further including the step of moving the second gripper assembly to a position below the first plane after disengaging the second gripper assembly from the workpiece.

* * * * *